US006998373B1

(12) United States Patent
Faines, Jr. et al.

(10) Patent No.: US 6,998,373 B1
(45) Date of Patent: Feb. 14, 2006

(54) SOAP RETAINING POUCH

(76) Inventors: James Lee Faines, Jr., 3555 Lisbon Dr., San Jose, CA (US) 35132-1319; Juanita Evon Faines Stinson, 8000 Colebrook Rd., Richmond, VA (US) 23227-1612

( * ) Notice: Subject to any disclaimer, the term of this patent is extended or adjusted under 35 U.S.C. 154(b) by 0 days.

(21) Appl. No.: 10/989,848

(22) Filed: Nov. 15, 2004

(51) Int. Cl.
*C11D 17/00* (2006.01)

(52) U.S. Cl. ..... 510/141; 401/201; 15/208; 15/229.11; 15/229.12; 15/229.13

(58) Field of Classification Search ..... 510/142; 401/201
See application file for complete search history.

(56) References Cited

*Primary Examiner*—Necholus Ogden

(57) ABSTRACT

Soap retaining pouch that is approximately five inches tall by three and one half inches wide. The pouch is made of polyester screening having a thread count of approximately fourteen lines per inch or one hundred and ninety six squares per square inch. An elastic band is centrally attached to the outside of the pouch at the right and left edge of the pouch's width. The pouch is closable at one end by a water resistant zipper. The pouch includes an overflap that covers the zipper so that the zipper is not exposed to the user's skin during use.

1 Claim, 5 Drawing Sheets

SOAP RETAINING POUCH

CROSS REFERENCE TO RELATED APPLICATIONS

Not Applicable

STATEMENT REGARDING FEDERALLY SPONSORED RESEARCH OR DEVELOPMENT

Not Applicable
Description of Attached Appendix
Not Applicable

BACKGROUND OF THE INVENTION

This invention relates generally to the field of bathing accessories and more specifically to a soap retaining pouch.

Bars of soap, used for cleaning ones skin with the application of water, have been in use for over one hundred years. Although soap generally does a good job in removing dirt from the skin, it does not generally remove the top dead layer of skin. The process of removing the top dead layer of skin is called exfoliation and can be accomplished with a mildly abrasive material such as a luffa, or a brush.

Some manufacturers have made products that are pouch shaped and hold a bar of soap so that a person can provide a cleaning and exfoliating action in one step. These products however do not include the specific combination of features that I believe contribute to the ideal combination of an inexpensive cleaning and exfoliating device. For example, some products are made of mesh material, but the material does not have the ideal screen size for exfoliation. Additionally, some products include a closure means made of hook and loop type material which is stiff and bulky and therefore not an ideal closure. Finally, some products include a hand retaining strap, however they tend to be non elastic and require additional hook and loop fastening thereby increasing the price of the unit.

BRIEF SUMMARY OF THE INVENTION

The primary object of the invention is to provide an inexpensive soap retaining pouch that allows a user to exfoliate his or her skin while using a bar of soap during the normal process of bathing.

Another object of the invention is to provide a soap retaining pouch that provides a way to keep the pouch from slipping out of the users hand during use.

Another object of the invention is to provide a soap retaining pouch that allows the soap to be securely retained and easily removed without adding unnecessary bulk to the pouch.

A further object of the invention is to provide a soap retaining pouch that allows the user to add a plurality of small scraps of normally unusable soap into the pouch thereby saving soap expense.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a soap retaining pouch comprising: a pouch approximately five inches tall by three and one half inches wide, made of polyester screening material having a screen with a thread count of approximately fourteen lines per inch or one hundred and ninety six squares per square inch, an elastic band centrally located, horizontally disposed and fixedly attached to the outside of one side of said pouch at the right and left edge of the width of said pouch, said pouch closable at one end by means of a water resistant zipper, and said pouch including an overflap that covers said zipper so that said zipper is not exposed to the user's skin during use.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
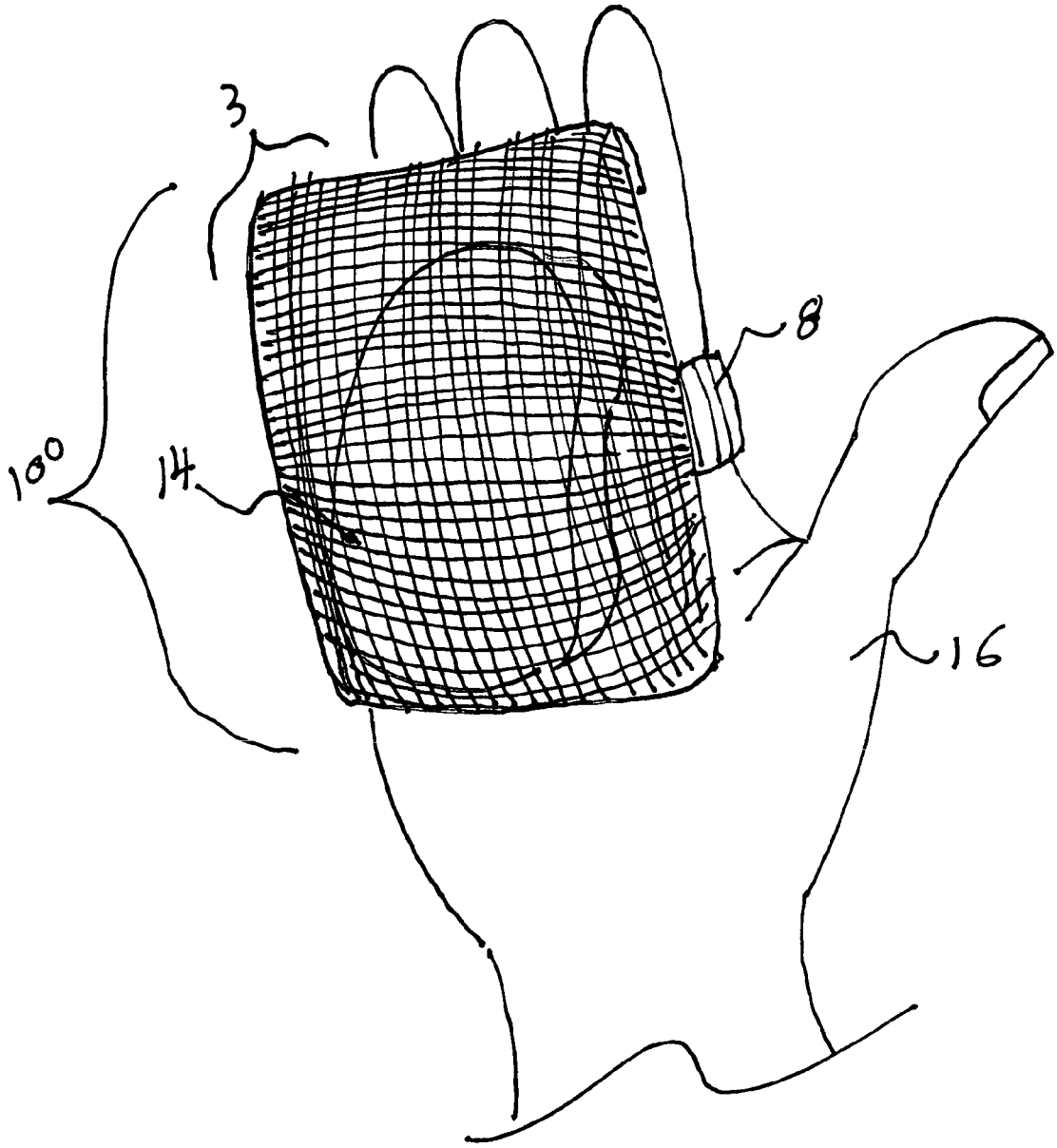
FIG. 1 is a perspective view of the invention in use.
Figure 2:
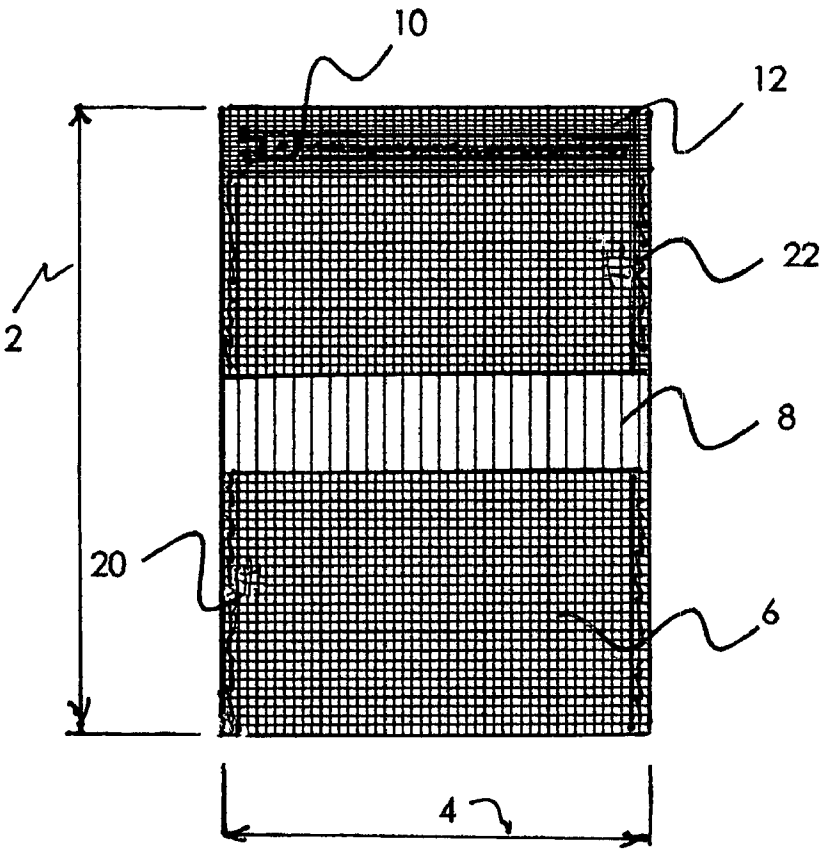
FIG. 2 is a back view of the invention.
Figure 3:
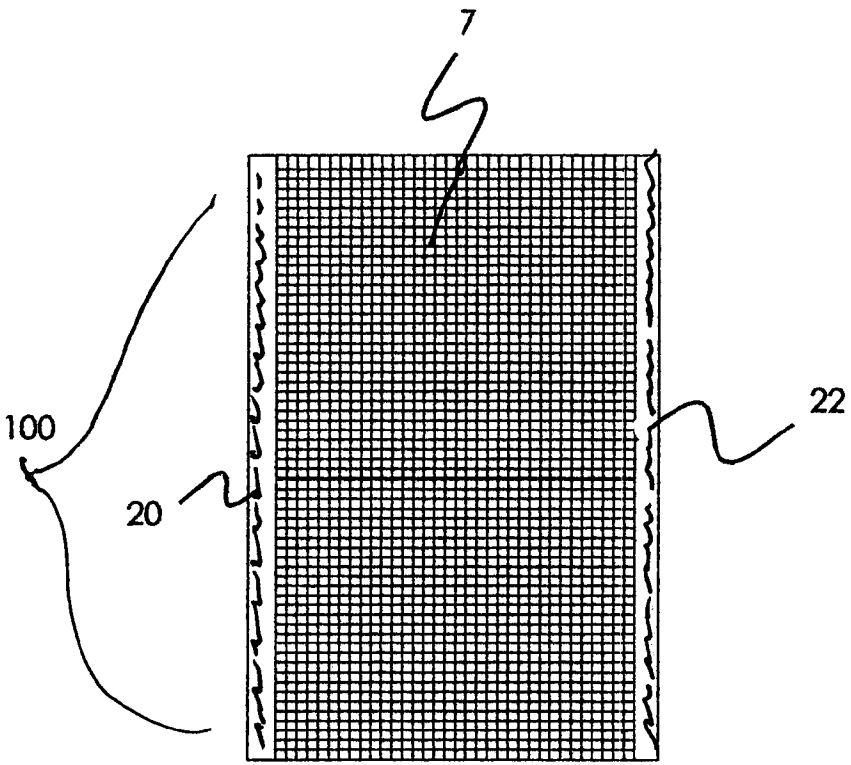
FIG. 3 is a front view of the invention.
Figure 4:
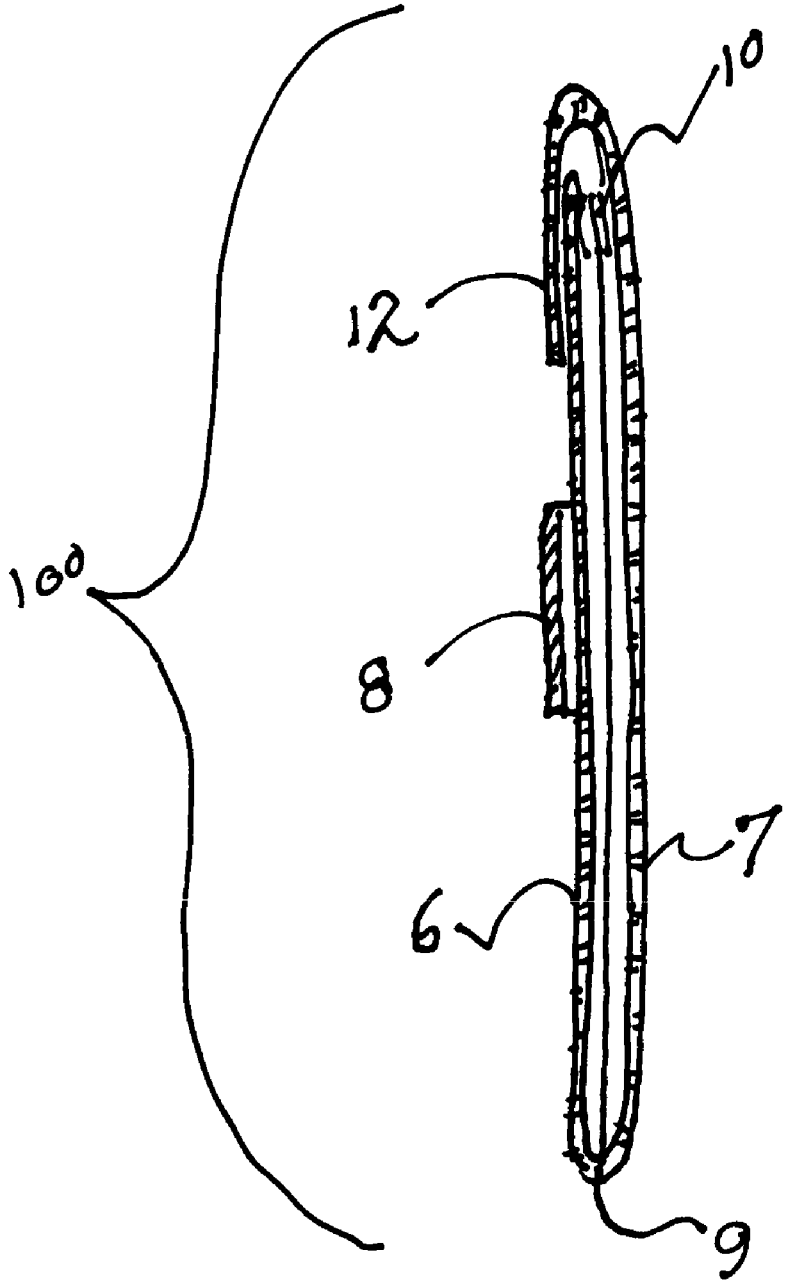
FIG. 4 is a side section view of the invention.
Figure 5:
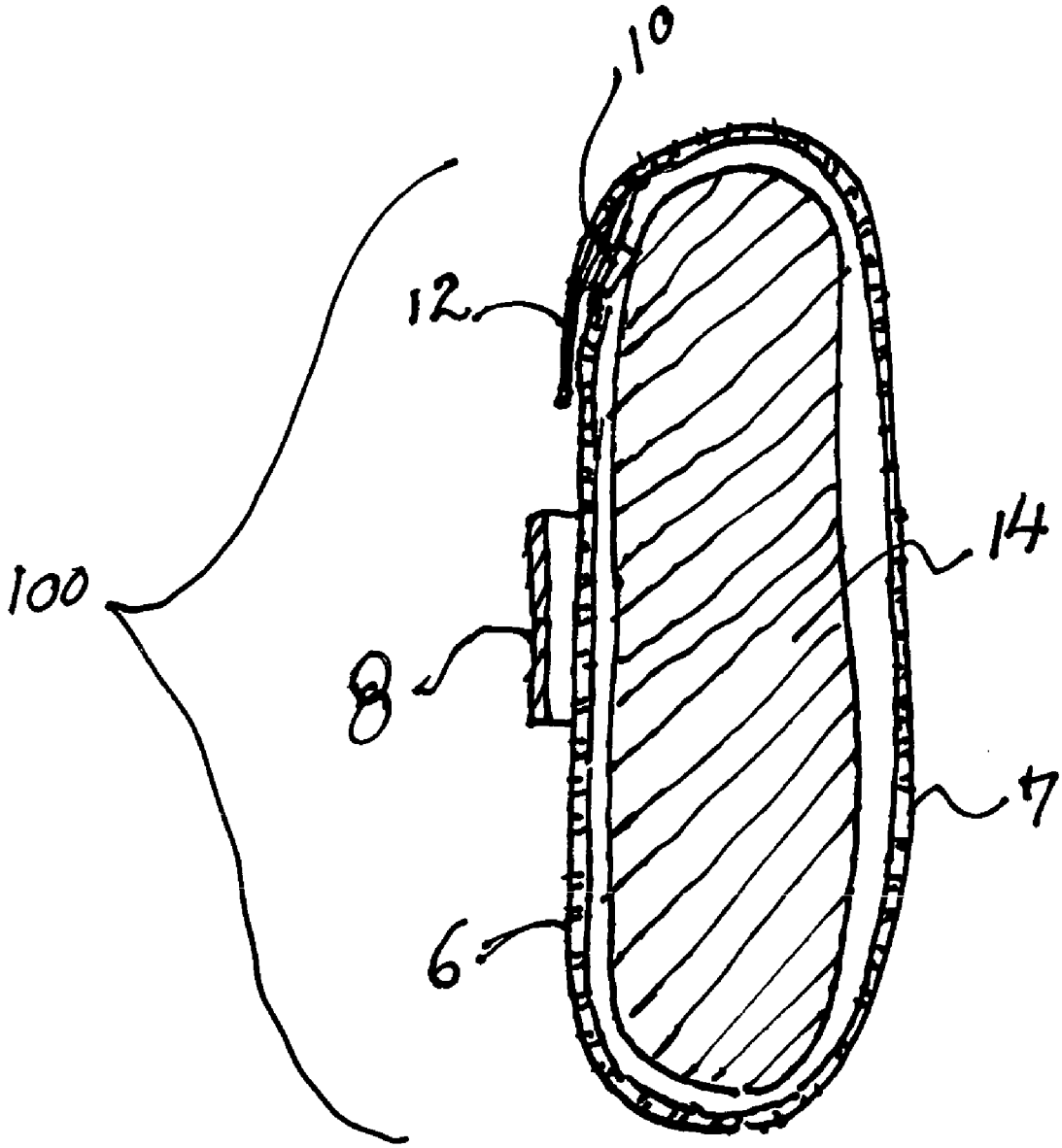
FIG. 5 is a side section view with soap installed.

Referring now to FIG. 1 we see a perspective view of the invention 100 while it is attached to a person's hand 16 via an elastic band 8. The main portion of the invention 100 consists of a pouch 3 that can retain a standard bar of soap 14. The pouch is made of polyester screening that has a thread count of approximately fourteen threads per linear inch or one hundred and ninety six squares per square inch. Each thread is approximately six thousandths of an inch in diameter. I have found through my experiments that this material, with the above mentioned thread count, is an ideal skin exfoliating tool. That is, this material acts as an ideal skin scraping agent without undo irritation to the user's skin. The ideal size of the pouch is approximately five inches tall as shown by dimension line 2 in FIG. 2 and three and one half inches wide as shown by dimension line 4. FIG. 2 shows a back view of the pouch 3 where the polyester screen material 6 can be seen as well as the elastic band 8 which is centrally connected in a horizontal orientation and fastened at the right edge 20 and left edge 22. The polyester screen is folded at the bottom 9 and stitched along edges 20, 22. An overflap 12 covers water resistant zipper 10. FIG. 3 shows the front 7 of the invention 100 which is devoid of extraneous materials so that it can be an effective cleaning surface. My experiments show that soap easily exits the apertures in the screen face 7 and yet can retain small slivers of soap so that the user can make use of every last portion of soap thereby saving on soap costs. FIG. 4 shows a side section view of the invention 100. Front surface 7 and back surface 6 are connected by hinged portion 9. Zipper 10 is relatively thin in shape so that the entire invention 100 can be bent and contoured during use without the closure getting in the way, which is the case with other closures such as hook and loop fasteners. Overflap 12 protects the user from contact with zipper 10. Elastic hand retaining band 8 is able to conform to a variety of sizes of hands. FIG. 5 shows a side section view of the invention 100 showing a bar of soap 14 in place.

The above description and drawings show that the present invention is a unique and economical means to exfoliate and clean ones skin while bathing.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Soap Bar Retaining Pouch comprising:

a pouch approximately five inches tall by three and one half inches wide, made of polyester screening material having a thread count of approximately fourteen lines per inch or one hundred and ninety six squares per square inch, each thread being approximately six thousandths of an inch in diameter;

an elastic band centrally located, horizontally disposed and fixedly attached to the outside of one side of said pouch at the right and left edge of the width of said pouch;

said pouch closable at one end by means of a water resistant zipper; and said pouch including an overflap that covers said zipper so that said zipper is not exposed to the user's skin during use.

* * * * *